US009315307B2

(12) United States Patent
Akaogi et al.

(10) Patent No.: US 9,315,307 B2
(45) Date of Patent: Apr. 19, 2016

(54) CONTAINER CLOSURE

(75) Inventors: Takahiro Akaogi, Kanagawa (JP); Motokatsu Yamada, Kanagawa (JP); Ryuichi Tsukamoto, Kanagawa (JP); Atsushi Watanabe, Kanagawa (JP)

(73) Assignee: NIPPON CLOSURES CO., LTD., Tokyo (JP)

( * ) Notice: Subject to any disclaimer, the term of this patent is extended or adjusted under 35 U.S.C. 154(b) by 442 days.

(21) Appl. No.: 13/988,125

(22) PCT Filed: Nov. 11, 2011

(86) PCT No.: PCT/JP2011/076044

§ 371 (c)(1),
(2), (4) Date: May 17, 2013

(87) PCT Pub. No.: WO2012/070407

PCT Pub. Date: May 31, 2012

(65) Prior Publication Data

US 2013/0228578 A1 Sep. 5, 2013

(30) Foreign Application Priority Data

Nov. 25, 2010 (JP) ..... 2010-262823

(51) Int. Cl.
*B65D 51/18* (2006.01)
*B65D 47/08* (2006.01)
*B65D 43/16* (2006.01)

(52) U.S. Cl.
CPC ..... *B65D 51/18* (2013.01); *B65D 47/0814* (2013.01); *B65D 47/0885* (2013.01); *B65D 2251/0025* (2013.01); *B65D 2251/0087* (2013.01)

(58) Field of Classification Search
CPC ..... B65D 47/0809; B65D 47/0823; B65D 47/0828; B65D 47/0861; B65D 47/0866; B65D 47/0871; B65D 47/0876; B65D 2547/06; B65D 51/18; B65D 47/0885; B65D 47/0814; B65D 2251/0025; B65D 2251/0087
USPC ..... 220/254.6, 254.2, 254.4, 255, 259.1, 220/259.2, 263, 254.3
See application file for complete search history.

(56) References Cited

U.S. PATENT DOCUMENTS 4,903,870 A * 2/1990 La Vange ..... B65D 47/305 220/254.6
5,819,972 A * 10/1998 Puente Pubill ..... B65D 17/165 220/255

(Continued)

FOREIGN PATENT DOCUMENTS

JP 165250/1987 10/1987
JP 2001-206414 7/2001

(Continued)

OTHER PUBLICATIONS

International Search Report issued in PCT/JP2011/076044 Feb. 21, 2012.

*Primary Examiner* — J. Gregory Pickett
*Assistant Examiner* — Niki Eloshway
(74) *Attorney, Agent, or Firm* — Greenblum & Bernstein, P.L.C.

(57) ABSTRACT

A container closure integrally formed from a synthetic resin includes a body, which has an upper surface wall, and an outer lid connected to the body so as to be pivotable between a closed position at which the upper surface wall of the body is covered and an open position at which the upper surface wall of the body is opened, wherein a raised portion having discharge ports formed on both sides is disposed on the upper surface wall of the body, the discharge ports formed on both sides of the raised portion are opened when the outer lid is pivoted to the open position, while the discharge ports formed on both sides of the raised portion are sealed fully reliably when the outer lid is pivoted to the closed position.

7 Claims, 18 Drawing Sheets

(56) References Cited

U.S. PATENT DOCUMENTS

| | | | | |
|---|---|---|---|---|
| 5,884,793 | A * | 3/1999 | Wang | B65D 47/0838 215/229 |
| 5,897,013 | A * | 4/1999 | Manganiello | A47G 19/2266 215/229 |
| 6,390,341 | B1 * | 5/2002 | Ohmi | B65D 47/0809 222/182 |
| 6,991,126 | B2 * | 1/2006 | Jackel | A47G 19/2266 220/259.1 |
| 8,376,173 | B2 * | 2/2013 | Britto | A47G 19/2266 206/217 |

FOREIGN PATENT DOCUMENTS

| | | |
|---|---|---|
| JP | 2008-74470 | 7/2001 |
| JP | 2009-286468 | 12/2009 |
| JP | 2010-126191 | 6/2010 |

* cited by examiner

CONTAINER CLOSURE

TECHNICAL FIELD

This invention relates to a container closure integrally formed from a synthetic resin, the container closure including a body which has an upper surface wall, and an outer lid connected to the body so as to be pivotable between a closed position at which the upper surface wall of the body is covered and an open position at which the upper surface wall of the body is opened, wherein a raised portion having discharge ports formed on both sides, or a single discharge tube is disposed on the upper surface wall of the body.

BACKGROUND ART

Patent Document 1 to be described below discloses a container closure integrally formed from a synthetic resin and including a body and an outer lid, as a container closure which is applied to a container formed from a suitable synthetic resin, such as polyethylene terephthalate, or glass and adapted for containing a seasoning such as soy sauce, in particular. The body has an upper surface wall, and a cylindrical side wall extending downwardly from the peripheral edge of the upper surface wall, while the outer lid has a top panel wall, and a cylindrical skirt wall extending downwardly from the peripheral edge of the top panel wall. The skirt wall of the outer lid and the side wall of the body are connected via first hinge means which defines a first pivot axis extending horizontally, and the outer lid can be pivoted, about the first pivot axis as a pivot center, between a closed position at which the upper surface wall of the body is covered and an open position at which the upper surface wall of the body is exposed. A raised portion rising upward and having discharge ports formed on both sides in the direction of the first pivot axis is disposed in a middle part of the upper surface wall of the body.

In discharging the contents of the container, the outer lid is pivoted to the open position to expose the upper surface wall of the body, accordingly, the raised portion, and then the container is tilted to direct downward one of the discharge ports formed in the raised portion. By so doing, the contents are discharged through the one of the discharge ports, and such discharge of the contents is promoted by the flow of outside air into the container through the other discharge port.

Patent Documents 2 and 3 to be described below each disclose a container closure integrally formed from a synthetic resin and including a body, which has an upper surface wall and a cylindrical side wall extending downwardly from the peripheral edge of the upper surface wall, and an outer lid, which has a top panel wall and a cylindrical skirt wall extending downwardly from the peripheral edge of the top panel wall, wherein the skirt wall of the outer lid and the side wall of the body are connected via first hinge means which extends horizontally, and the outer lid can be pivoted between a closed position at which the upper surface wall of the body is covered and an open position at which the upper surface wall of the body is exposed. A discharge tube extending out away from the first hinge means and having a discharge port formed at the front end is disposed on the top panel wall of the body. To the upper surface of the discharge tube, an inner lid is connected via second hinge means so as to be pivotable between a closed position at which the discharge port is covered and an open position at which the discharge port is opened. Interference means is disposed on the inner peripheral surface of the skirt wall of the outer lid. The interference means interferes with the inner lid to move the inner lid pivotally from the closed position to the open position while the outer lid is being pivoted from the closed position to the open position, whereafter the interference means is separated from the inner lid. Moreover, the interference means interferes with the inner lid to pivot the inner lid from the open position to the closed position while the outer lid is being pivoted from the open position to the closed position, whereafter the interference means is separated from the inner lid. Pressing means, which contacts the inner lid to force the inner lid into the closed position when the outer lid is pivoted from the open position to the closed position, is formed on the inner peripheral surface of the skirt wall and/or the inner surface of the top panel wall of the outer lid. The inner lid is a plate-shaped piece jutting out beyond opposite side surfaces of the discharge tube, and a seal ring engaging the discharge port is formed in a middle part of the inner surface of the inner lid. Stop projections are formed in opposite side parts of the inner surface of the inner lid, and receiving projections extending out upwards from the opposite side surfaces of the discharge tube are formed in the discharge tube. The stop projections ride resiliently over the receiving projections when the inner lid is moved pivotally from the closed position to the open position and when the inner lid is moved pivotally from the open position to the closed position.

PRIOR ART DOCUMENTS

Patent Documents

Patent Document 1: JP-A-2009-286468
Patent Document 2: JP-A-2008-74470
Patent Document 3: JP-A-2010-126191

SUMMARY OF THE INVENTION

Problems to be Solved by the Invention

The above-described container closure disclosed in Patent Document 1 poses the following problems to be solved: When the outer lid is located at the closed position, the inner peripheral surface of the skirt wall of the outer lid is brought into contact with the discharge ports formed on both sides of the raised portion, whereby it is attempted to seal both discharge ports. However, the inner peripheral surface of the skirt wall of the outer lid is cylindrical or truncated cone-shaped, and curved in the circumferential direction. Because of these facts, etc., sealing of the discharge ports becomes so insufficient that when the container topples over, the contents may leak.

The above-described container closures disclosed in Patent Documents 2 and 3, on the other hand, pose the following problems in connection with their usability: When the contents of a container formed from a suitable synthetic resin or glass are to be consumed, with the container closure being mounted on a mouth-and-neck portion of the container, a consumer, for example, grasps the container with the right hand, and pivots the outer lid of the container closure from the closed position to the open position with the use of the left hand. As a result, the discharge tube is exposed, with the discharge ports open, but the discharge ports of the discharge tube are open toward the consumer. Before discharging the contents through the discharge ports, therefore, it is necessary to release the grasp of the container once, and grasp the container again with the right hand or the left hand, while changing the direction of grasp. The operation of discharging the contents is thus tiresome.

The present invention has been accomplished in the light of the above-mentioned facts. Its first technical challenge is to improve the above container closure disclosed in Patent Document 1 such that when the outer lid is pivoted to the open position, the discharge ports formed on both sides of the raised portion are opened, and when the outer lid is pivoted to the closed position, the discharge ports formed on both sides of the raised portion are sealed sufficiently reliably, with no special operation being required in addition to the pivotal movements of the outer lid for opening and closing.

A second technical challenge to the present invention is to improve the above container closures disclosed in Patent Documents 2 and 3 such that in discharging the contents of the container, there is no need to release the grasp of the container once and grasp the container again, and that after the container is grasped with the right hand, and the outer lid of the container closure is pivoted from the closed position to the open position with the use of the left hand, for example, the right hand is rotated in a suitable direction in the unchanged state, whereby the contents are allowed to be discharged through the discharge ports.

Means for Solving the Problems

The present inventors conducted in-depth studies and experiments, and have found that the above first technical challenge can be solved by connecting the inner lids to the raised portion via second hinge means, in association with each of the discharge ports formed on both sides of the raised portion, so as to be pivotable between the closed position at which the discharge ports are covered and the open position at which the discharge ports are opened; and by disposing interference means on the inner peripheral surface of the skirt wall of the outer lid, in association with each of the inner lids, such that the interference means interfere with the inner lids to pivot the inner lids from the open position toward the closed position while the outer lid is being pivoted from the open position to the closed position, and then the interference means ride over the inner lids and become separated from the inner lids, and that the interference means interfere with the inner lids to pivot the inner lids from the closed position toward the open position while the outer lid is being pivoted from the closed position to the open position, and then the interference means are separated from the inner lids.

That is, according to a first aspect of the present invention, there is provided, as a container closure solving the above-mentioned first technical challenge, a container closure integrally formed from a synthetic resin and including a body, which has an upper surface wall and a cylindrical side wall extending downwardly from a peripheral edge of the upper surface wall, and an outer lid, which has a top panel wall and a cylindrical skirt wall extending downwardly from a peripheral edge of the top panel wall, wherein the skirt wall of the outer lid and the side wall of the body are connected via first hinge means which defines a first pivot axis extending horizontally, and the outer lid is free to pivot, about the first pivot axis as a pivot center, between a closed position at which the upper surface wall of the body is covered and an open position at which the upper surface wall of the body is exposed; and a raised portion which rises upward and which has discharge ports formed on opposite sides thereof in a direction of the first pivot axis is disposed in a middle part of the upper surface wall of the body, characterized in that inner lids are connected to the raised portion via second hinge means, in association with the discharge ports, respectively, so as to be pivotable between a closed position at which the discharge ports are covered and an open position at which the discharge ports are opened; and interference means are disposed on an inner peripheral surface of the skirt wall of the outer lid, in association with the inner lids, respectively, such that the interference means interfere with the inner lids to pivot the inner lids from the open position toward the closed position while the outer lid is being pivoted from the open position to the closed position, and then the interference means ride over the inner lids and become separated from the inner lids, and that the interference means interfere with the inner lids to pivot the inner lids from the closed position toward the open position while the outer lid is being pivoted from the closed position to the open position, and then the interference means are separated from the inner lids.

Preferably, the interference means is composed of a tongue-shaped piece protruding radially inwardly from the inner peripheral surface of the skirt wall of the outer lid, and extending in a downwardly inclined manner away from the first pivot axis. It is preferred that pressing means be disposed on the inner peripheral surface of the skirt wall of the outer lid, in association with the inner lids, respectively, such that the pressing means contact outer surfaces of the inner lids to force the inner lids into the closed position while the outer lid is being pivoted from the open position to the closed position. Preferably, a barrier wall hanging down from a middle of an inner surface of an upper end wall of the raised portion to cut off from each other the discharge ports formed on the opposite sides of the raised portion in the direction of the first pivot axis is formed in the raised portion. Advantageously, the raised portion has opposite side walls on the opposite sides thereof in the direction of the first pivot axis, the opposite side walls extending vertically, and the discharge ports are defined at leading ends of discharge tubes protruding horizontally from the opposite side walls, respectively; or the raised portion has opposite side walls on the opposite sides thereof in the direction of the first pivot axis, the opposite side walls extending downwardly and being inclined bilaterally outwardly in the direction of the first pivot axis, and the discharge ports are defined at leading ends of discharge tubes, the discharge tubes extending out upwardly from the opposite side walls, respectively, and being inclined bilaterally outwardly in the direction of the first pivot axis. Preferably, stop projections are formed in opposite side parts of an inner surface of the inner lid, receiving projections as a pair are formed in the raised portion in correspondence with the stop projections, and the stop projections resiliently ride over the receiving projections when the inner lid is pivoted from the closed position to the open position.

According to a second aspect of the present invention, the aforementioned second technical challenge is solved by the configuration in which the direction of extension of the discharge tube is rendered not a direction in which the discharge tube goes away from the first pivot axis, but a direction along the first pivot axis.

That is, according to the second aspect of the present invention, there is provided, as a container closure solving the above-mentioned second technical challenge, a container closure integrally formed from a synthetic resin and including a body, which has an upper surface wall and a cylindrical side wall extending downwardly from a peripheral edge of the upper surface wall, and an outer lid, which has a top panel wall and a cylindrical skirt wall extending downwardly from a peripheral edge of the top panel wall, wherein the skirt wall of the outer lid and the side wall of the body are connected via first hinge means which defines a first pivot axis extending horizontally; the outer lid is free to pivot between a closed position at which the upper surface wall of the body is covered and an open position at which the upper surface wall is exposed; a discharge tube having a discharge port formed at a leading end thereof is disposed on the upper surface wall of the body; an inner lid is connected to an upper surface of the discharge tube via second hinge means, which defines a second pivot axis, so as to be pivotable between a closed position at which the discharge port is covered and an open position at which the discharge port is opened; and interference means is disposed on an inner peripheral surface of the skirt wall of the outer lid such that the interference means interferes with the inner lid to move the inner lid pivotally from the closed position to the open position while the outer lid is being pivoted from the closed position to the open position, and then the interference means rides over the inner lid and becomes separated from the inner lid, and that the interference means interferes with the inner lid to pivot the inner lid from the open position toward the closed position while the outer lid is being pivoted from the open position to the closed position, and then the interference means is separated from the inner lid, characterized in that the discharge tube is extended out along the first pivot axis.

Preferably, the discharge tube is extended out parallel to the first pivot axis, or at an inclination angle of $\alpha$, 0 degrees$<\alpha\leq$45 degrees, in a direction in which the discharge tube gradually separates from the first pivot axis toward the leading end. It is preferred that the interference means is composed of a tongue-shaped piece protruding radially inwardly from the inner peripheral surface of the skirt wall of the outer lid, and the tongue-shaped piece extends in a downwardly inclined manner away from the first pivot axis when the outer lid is located at the closed position and/or the second pivot axis extends upwardly obliquely away from the first pivot axis.

Effects of the Invention

With the container closure constituted in accordance with the first aspect of the present invention, when the outer lid is pivoted from the closed position to the open position, the inner lids are automatically pivoted from the closed position to the open position by the action of the interference means. Accordingly, simply by tilting the container in the required direction, the contents can be discharged through one of the discharge ports, and outside air can be flowed into the container through the other discharge port. When the outer lid is pivoted from the open position to the closed position, the inner lids are automatically pivoted from the open position to the closed position by the action of the interference means. As a result, the discharge ports formed on both sides of the raised portion are sealed. Sealing of the discharge, ports does not depend on the skirt wall of the outer lid, but depends on the inner lids separately disposed. Thus, the discharge ports can be sealed fully reliably.

with the container closure constituted in accordance with the second aspect of the present invention, in a state where the container closure is mounted on the mouth-and-neck portion of the container, a consumer, for example, grasps the container with the right hand, and pivots the outer lid of the container closure from the closed position to the open position with the use of the left hand. As a result, the discharge tube is exposed, with the discharge port being open not toward the consumer, but in a direction nearly orthogonal to the right wrist of the consumer, namely, in a lateral direction. Thus, the contents can be discharged through the discharge port, simply by rotating the right wrist in a suitable direction, without the need to release the grasp of the container once and grasp the container again.

MODE FOR CARRYING OUT THE INVENTION

Preferred embodiments of a container closure constituted according to the present invention will now be described in further detail with reference to the accompanying drawings.

Figure 1:
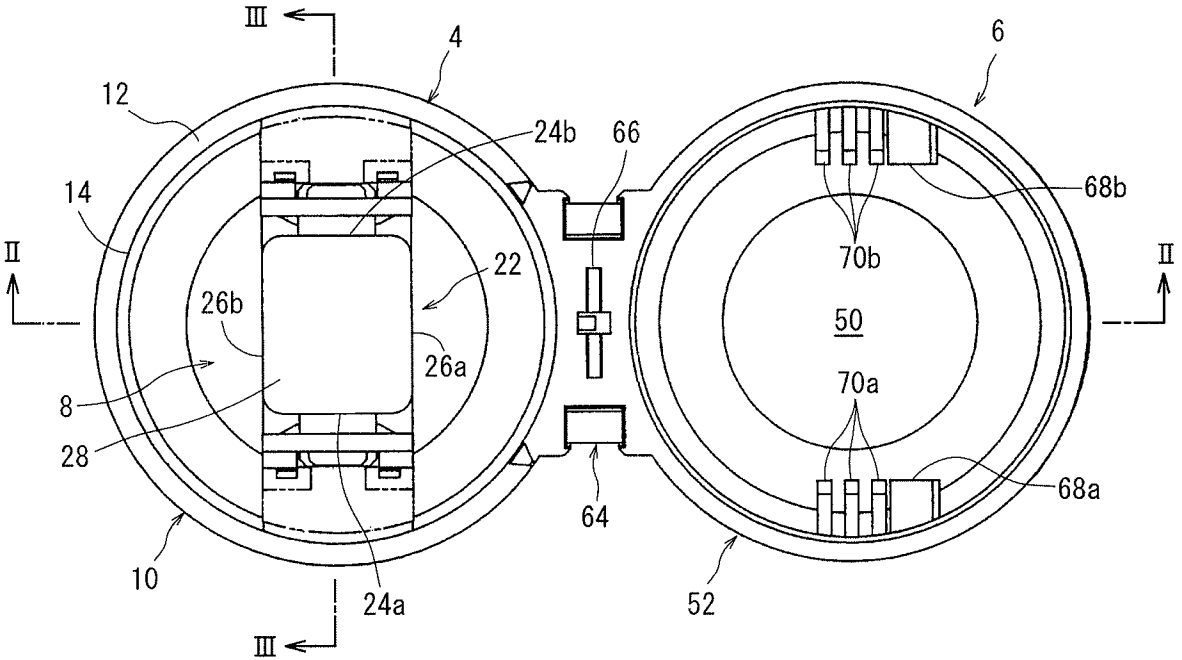
FIG. 1 is a plan view showing a preferred embodiment of a container closure constituted in accordance with a first aspect of the present invention, in an as-molded state (a state in which an outer lid is pivoted 180 degrees from a closed state).
Figure 2:
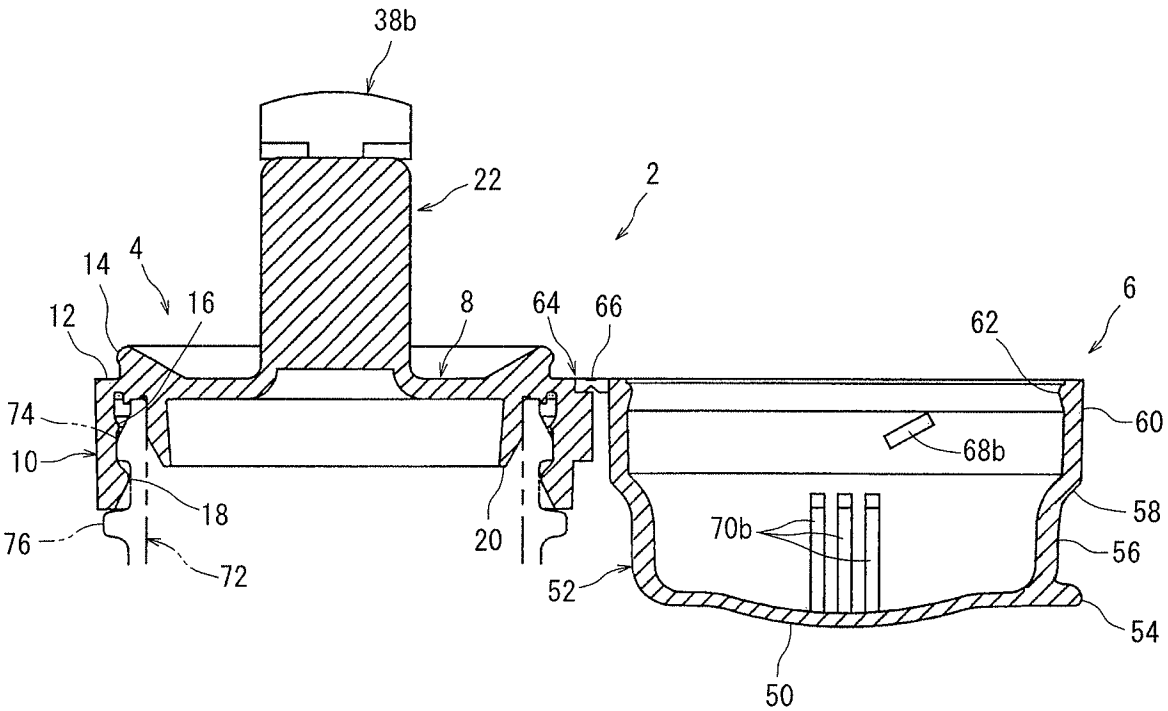
FIG. 2 is a sectional view taken on line II-II of FIG. 1.
Figure 3:
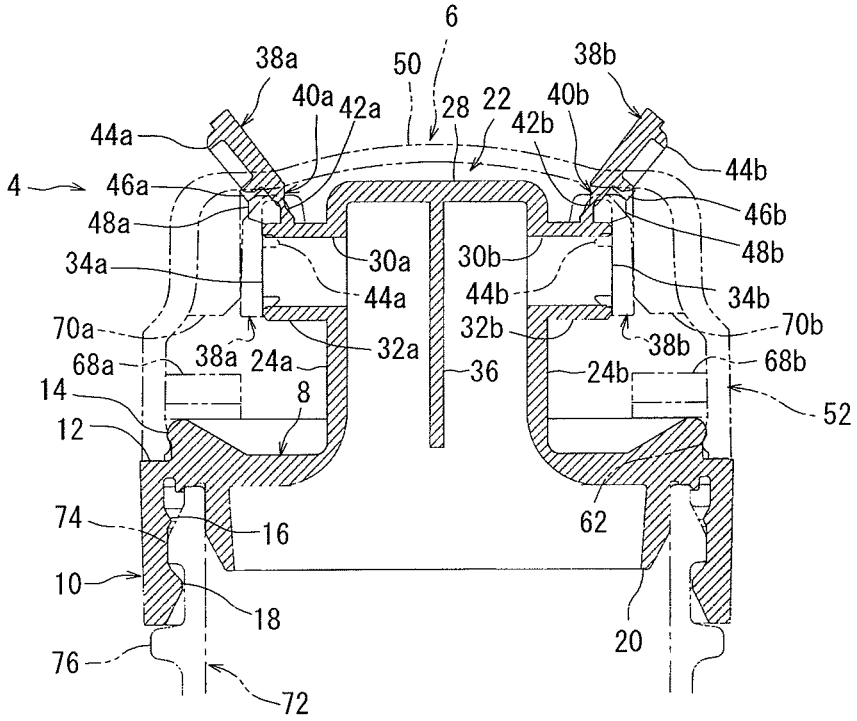
FIG. 3 is a sectional view taken on line of FIG. 1.

With reference to FIGS. 1 to 3 showing, in the as-molded state, the preferred embodiment of the container closure constituted in accordance with a first aspect of the present invention, the container closure designated generally as the numeral 2 includes a body and an outer lid integrally molded from a suitable synthetic resin such as polyethylene or polypropylene. The body has an upper surface wall, circular in a plan view, and a cylindrical side wall 10 of a nearly cylindrical shape extending downwardly from the peripheral edge of the upper surface wall 8. An outer peripheral edge part of the upper surface wall 8 is projected upward radially outwardly. An annular shoulder surface 12 directed upward is formed in an outermost peripheral edge part of the upper surface wall 8. An annular stop ridge 14 protruding radially outwardly is formed in an upper end part of the upper surface wall 8. The cylindrical side wall 10 hangs down substantially vertically, and has an outer peripheral surface of a cylindrical shape. An upper annular ridge 16 protruding radially inwardly is formed in an upper part of the inner peripheral surface of the cylindrical side wall 10, while a lower annular ridge 18 protruding radially inwardly is formed in a lower part of the inner peripheral surface of the cylindrical side wall 10. The amount of radially inward protrusion of the upper annular ridge 16 is relatively small, whereas the amount of radially inward protrusion of the lower annular ridge 18 is relatively large. An annular sealing piece 20 extending out downwardly from a position somewhat radially inward of the cylindrical side wall 10 is formed on the lower surface of the upper surface wall 8.

Figure 4:
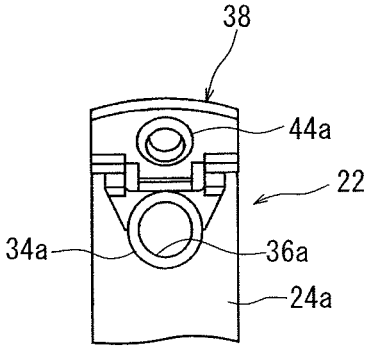
FIG. 4 is a partial front view illustrating a raised portion in the container closure of FIG. 1.

With further reference to FIG. 4 along with FIGS. 1 to 3, a raised portion 22 rising upward is disposed in a middle part of the upper surface wall 8. In the illustrated embodiment, the raised portion 22 is in the shape of a rectangular parallelepiped, and has four side walls extending substantially vertically, namely, opposite side walls 24*a* and 24*b* and opposite end walls 26*a* and 26*b*, and a top surface wall 28 extending substantially horizontally. As clearly illustrated in FIG. 3, circular openings 30*a* and 30*b* are formed in the opposite side walls 24*a* and 24*b*, respectively, and discharge tubes 32*a* and 32*b* of a cylindrical shape extending substantially horizontally from outer peripheral parts of the circular openings 30*a* and 30*b* are annexed to the opposite side walls 24*a* and 24*b*. Circular openings present at the leading ends of the discharge tubes 32*a* and 32*b* define discharge ports 34*a* and 34*b*. As will be clearly understood by reference to FIG. 3, a barrier wall 36 hanging down substantially vertically from a middle part of the inner surface of the top surface wall 28 is disposed within the raised portion 22. Opposite edges of the barrier wall 36 are connected to the opposite end walls 26*a* and 26*b* of the raised portion 22, and the space within the raised portion 22 is halved by the barrier wall 36. Thus, the openings 30*a* and 30*b* formed in the opposite side walls 24*a* and 24*b*, accordingly, the discharge tubes 32*a* and 32*b* and the discharge ports 34*a* and 34*b* present at their leading ends, are cut off from each other by the barrier wall 36.

Figure 5:
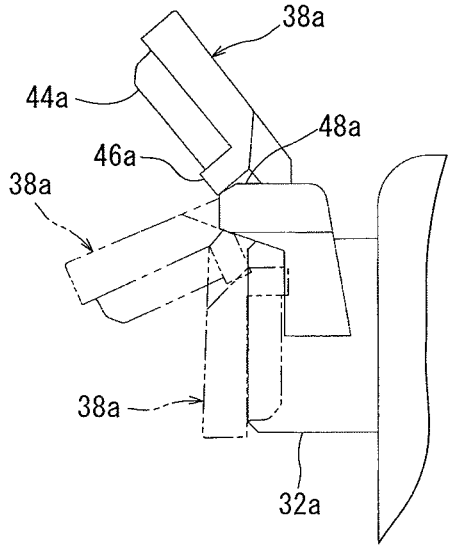
FIG. 5 is a partial side view showing the collaborative action of a stop projection of an inner lid and a receiving projection of the raised portion in the container closure of FIG. 1.

Inner lids 38*a* and 38*b* are annexed, respectively, to the discharge tubes 32*a* and 32*b* disposed in the raised portion 22. In more detail, as will be clearly understood by reference to FIGS. 3 and 4, connecting pieces 40*a* and 40*b* protruding upward are formed on the upper surfaces of the discharge tubes 32*a* and 32*b*, and the inner lids 38*a* and 38*b* are connected to the discharge tubes 32*a* and 32*b* via the connecting pieces 40*a* and 40*b*. Thin-walled hinges 42*a* and 42*b*, which extend substantially horizontally, in a direction perpendicular to the sheet face in FIG. 3, and in a lateral direction in FIG. 4, are formed in the connecting pieces 40*a* and 40*b* constituting hinge means (second hinge means). The inner lids 38*a* and 38*b* can be pivoted, about the thin-walled hinges 42*a* and 42*b* as the pivot centers, between an open position indicated by solid lines in FIGS. 3 and 4 and a closed position indicated by dashed double-dotted lines in FIG. 3. Each of the inner lids 38*a* and 38*b* is a nearly rectangular plate piece, and annular sealing protruding pieces 44*a* and 44*b* are formed on their inner surfaces. When the inner lids 38*a* and 38*b* are brought to the closed position, the annular sealing protruding pieces 44*a* and 44*b* are inserted into the discharge tubes 32*a* and 32*b*, whereby the discharge ports 34*a* and 34*b* are sealed. Stop projections 46*a* and 46*b* are formed in both side parts of the inner surfaces of the inner lids 38*a* and 38*b* and, correspondingly, receiving projections 48*a* and 48*b* protruding from both sides of the connecting pieces 40*a* and 40*b* are formed in the discharge tubes 32*a* and 32*b*. As will be clearly illustrated in FIG. 5, the receiving projections 48*a* and 48*b* each have an inclined surface, which inclines forwardly downwardly, in a boundary region between the upper surface thereof extending substantially horizontally and the front surface thereof extending substantially vertically. When the inner lids 38*a* and 38*b* are pivoted from the closed position indicated by the dashed double-dotted lines to the open position indicated by the solid lines, the stop projections 46*a* and 46*b* resiliently ride over the receiving projections 48*a* and 48*b*, and the stop projections 46*a*, 46*b* and the receiving projections 48*a*, 48*b* act collaboratively, more detailedly, the outer surfaces of lower end parts of the stop projections 46*a*, 46*b* contact the inclined surfaces of the receiving projections 48*a*, 48*b*, whereby the inner lids 38*a*, 38*b* are resiliently held at the open position. When the inner lids 38*a* and 38*b* are pivoted from the open position to the closed position, the stop projections 46*a* and 46*b* resiliently ride over the receiving projections 48*a* and 48*b*.

With further reference to FIGS. 1 to 3, the outer lid 6 has a top panel wall 50 and a cylindrical skirt wall 52 extending downwardly from the peripheral edge of the top panel wall 50. A main part of the top panel wall 50 is circular in a plan view, but an arcuate protruding piece 54 (FIG. 2) over which a finger can be hooked during the opening or closing motion of the outer lid 6 is annexed to a predetermined angular region of the top panel wall 50. The skirt wall 52 has a cylindrical upper part 56 of a relatively small diameter, a truncated cone-shaped intermediate part 58, and a cylindrical lower part 60 of a relatively large diameter. An annular stop ridge 62 protruding radially inwardly is formed in a lower end part of the inner peripheral surface of the skirt wall. As will be clearly illustrated in FIGS. 1 and 2, a predetermined angular region at the lower end of the outer peripheral surface of the skirt wall 52 of the outer lid 6 is connected to a predetermined angular region at the upper end of the outer peripheral surface of the cylindrical side wall 10 of the body 4 via a hinge means 64 (first hinge means). The hinge means 64, which may be of a well-known shape per se, has a thin-walled hinge 66 extending in a direction perpendicular to the sheet face of FIG. 2. The outer lid 6 is free to move pivotally, between an open position illustrated in FIGS. 1 to 3 and a closed position indicated by dashed double-dotted lines in FIG. 3, about a pivot axis (a first pivot axis) which is defined by the thin-walled hinge 66 and which extends substantially horizontally. When the outer lid 6 is located at the open position illustrated in FIGS. 1 to 3, the upper surface wall 8 of the body 4 is exposed. When the outer lid 6 is pivoted to the closed position indicated by the dashed double-dotted lines in FIG. 3, the upper surface wall 8 of the body 4 is covered with the outer lid 6. As will be clearly illustrated in FIG. 6, when the outer lid 6 is located at the closed position, the lower end surface of the skirt wall 52 of the outer lid 6 is brought into contact with the annular shoulder surface 12 present in the outermost peripheral edge part of the upper surface wall 8 of the body 4, and the annular stop ridge 62 formed on the inner peripheral surface of the skirt wall 52 of the outer lid 6 is resiliently locked to the annular stop ridge 14 formed in the upper end part of the upper surface wall 8 of the body 4, whereby the outer lid 6 is held resiliently at the closed position.

With further reference to FIGS. 1 and 2, interference means 68*a* and 68*b* and pressing means 70*a* and 70*b* are further disposed in the outer lid 6 in correspondence with the inner lids 38*a* and 38*b* disposed in the body 4. In the illustrated embodiment, each of the interference means 68*a* and 68*b* is composed of a tongue-shaped piece extending out radially inwardly from a predetermined angular position on the inner peripheral surface of a lower part 60 of the skirt wall 52. Such a tongue-shaped piece is extended in a downwardly inclined manner away from the pivot axis defined by the thin-walled hinge 66 when the outer lid 6 is located at the closed position indicated by the dashed double-dotted lines in FIG. 3. Each of the pressing means 70*a* and 70*b* is composed of three plate-shaped pieces protruding in the radial direction from the inner peripheral surface of the upper part 56 and the intermediate part 58 of the skirt wall 52. The three plate-shaped pieces are extended parallel to each other and substantially vertically, and their upper edges are connected to the inner surface of the top panel wall 50. It is important for the interference means 68*a* and 68*b* and the pressing means 70*a* and 70*b* to have dimensions and positions of disposition set so as to perform opening and closing actions and a pressing action, as will be described later, on the inner lids 38*a* and 38*b* of the body 4.

FIGS. 2 and 3 also illustrate a mouth-and-neck portion 72 of a container to which the container closure 2 is to be applied. The mouth-and-neck portion 72 of the container, which can be formed from a suitable synthetic resin such as polyethylene terephthalate, is in a cylindrical shape as a whole, and its top surface is open. An annular stop jaw portion 74 is formed in an upper part of the outer peripheral surface of the mouth-and-neck portion 72, which may itself be of a well-known shape. An annular ridge 76 located downwardly of the stop jaw portion 74 is further disposed on the outer peripheral surface of the mouth-and-neck portion 72. The annular ridge 76 is utilized for the transport of the container, and is generally called a support ring. By accommodating the mouth-and-neck portion 72 between the cylindrical side wall 10 and the annular sealing piece 20 of the body 4, the container closure 2 is mounted on the mouth-and-neck portion 72 of the container. The lower annular ridge 16 formed on the inner peripheral surface of the cylindrical side wall 10 resiliently rides over the stop jaw portion 74 of the mouth-and-neck portion 72, and the stop jaw portion 74 formed in the mouth-and-neck portion 72 is positioned between the upper annular ridge 16 and the lower annular ridge 18 formed on the inner peripheral surface of the cylindrical side wall 10. The annular sealing piece 20 of the body 4 advances into the mouth-and-neck portion 72, and makes close contact with the inner peripheral surface of the mouth-and-neck portion 72.

Figure 6:
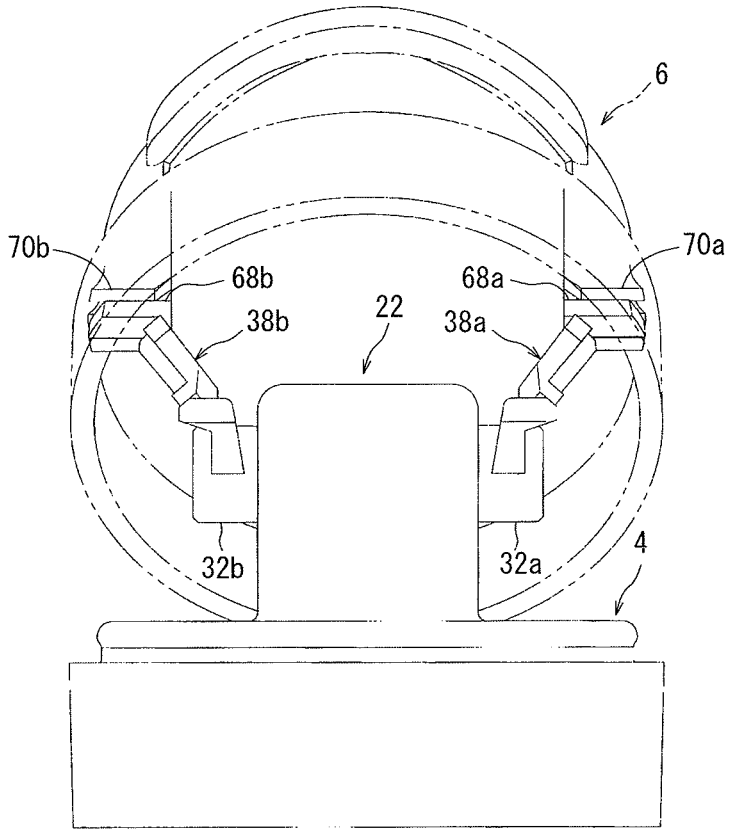
FIG. 6 is a side view showing the state of the container closure of FIG. 1 in which the outer lid has been somewhat pivoted from an open position toward a closed position.
Figure 7:
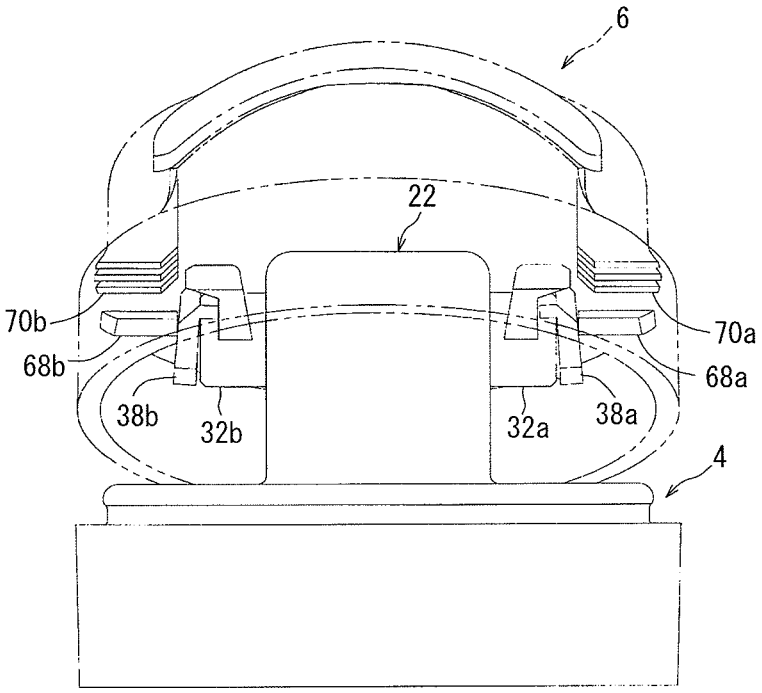
FIG. 7 is a side view showing the state of the container closure of FIG. 1 in which the outer lid has been somewhat pivoted from the state shown in FIG. 6 further toward the closed position.
Figure 8:
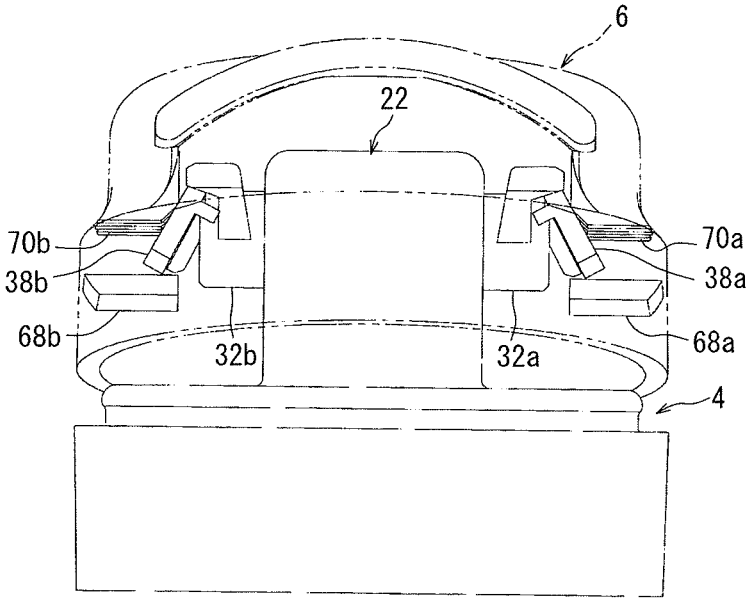
FIG. 8 is a side view showing the state of the container closure of FIG. 1 in which the outer lid has been somewhat pivoted from the state shown in FIG. 7 further toward the closed position.

The above-described container closure 2 exhibits the following actions and effects: As will be understood by reference to FIGS. 6 to 8, when the outer lid 6 is moved pivotally from the open position toward the closed position, the interference means 68*a* and 68*b* disposed in the outer lid 6 gradually approach the inner lids 38*a* and 38*b* disposed in the body 4 in accordance with the pivoting of the outer lid 6 (FIG. 6). Upon pivoting to a predetermined angle, the interference means 68*a* and 68*b* contact the outer surfaces of the inner lids 38*a* and 38*b*. When the outer lid 6 is further pivoted, the inner lids 38*a* and 38*b* are forcibly pivoted from the open position toward the closed position by the interferential action of the interference means 68*a* and 68*b* (FIG. 7). Then, the interference means 68*a* and 68*b* are separated from the inner lids 38*a* and 38*b* (FIG. 8). Upon separation of the interference means 68*a* and 68*b* from the inner lids 38*a* and 38*b*, the inner lids 38*a* and 38*b* somewhat return toward the open position resiliently. However, when the outer lid 6 is further pivoted toward the closed position, the pressing means 70*a* and 70*b* disposed in the outer lid 6 act on the outer surfaces of the inner lids 38*a* and 38*b* to pivot the inner lids 38*a* and 38*b* forcibly to the closed position. When the outer lid 6 is pivoted to the closed position, the inner lids 38*a* and 38*b* are forced into the closed position by the pressing action of the pressing means 70*a* and 70*b*. As a result, the discharge ports 34*a* and 34*b* disposed at the leading ends of the discharge tubes 32*a* and 32*b* are reliably closed, and the inner lids 38*a* and 38*b* are held at the closed position by the pressing action of the pressing means 70*a* and 70*b* (FIG. 3).

Figure 9:
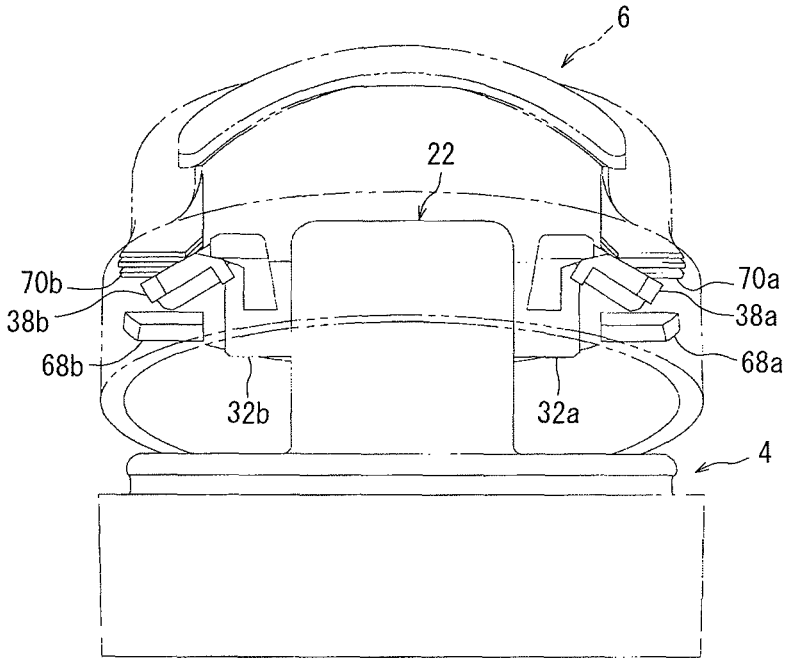
FIG. 9 is a side view showing the state of the container closure of FIG. 1 somewhat pivoted from the closed position toward the open position.
Figure 10:
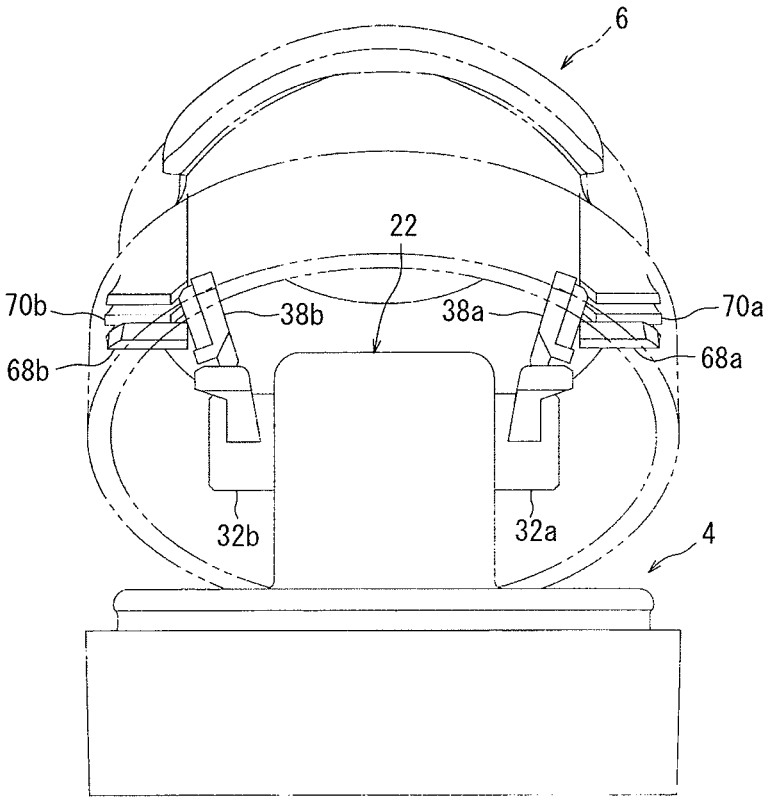
FIG. 10 is a side view showing the state of the container closure of FIG. 1 in which the outer lid has been somewhat pivoted from the state shown in FIG. 9 further toward the open position.
Figure 11:
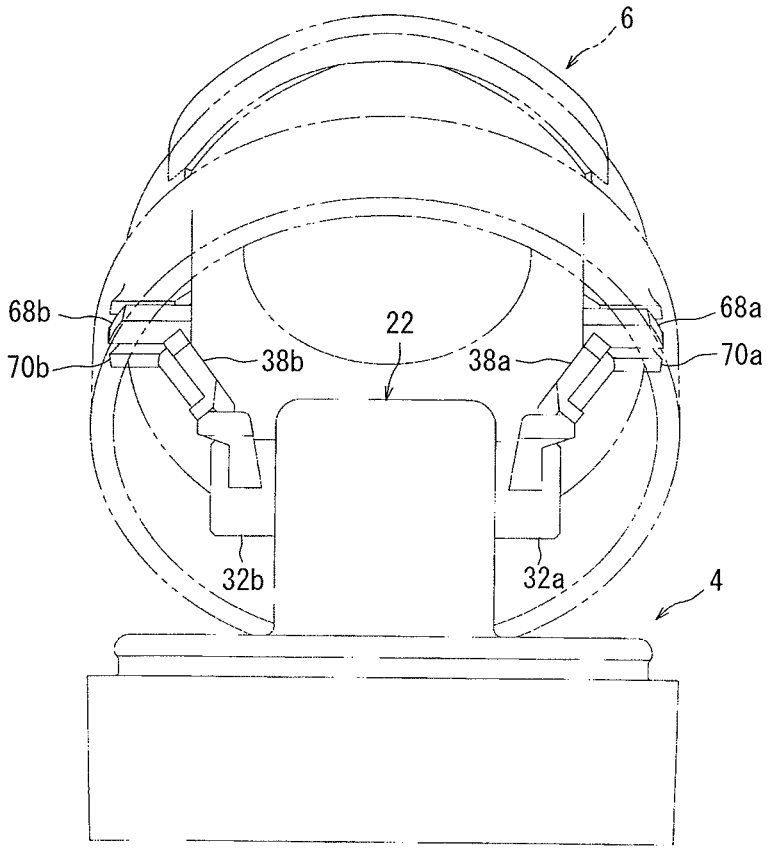
FIG. 11 is a side view showing the state of the container closure of FIG. 1 in which the outer lid has been somewhat pivoted from the state shown in FIG. 10 further toward the open position.

When the outer lid 6 is pivoted from the closed position toward the open position, on the other hand, the pressing means 70*a* and 70*b* are initially separated from the outer surfaces of the inner lids 38*a* and 38*b* in accordance with the pivoting of the outer lid 6, as will be understood by reference to FIGS. 9 to 11. Then, the interference means 68*a* and 68*b* contact the leading edges or inner surfaces of the inner lids 38*a* and 38*b* to start interfering with the inner lids 38*a* and 38*b*. In accordance with the pivoting of the outer lid 6, the inner lids 38*a* and 38*b* are pivoted from the closed position toward the open position by the action of the interference means 68*a* and 68*b* (FIGS. 9 and 10). When the outer lid 6 is further pivoted, the interference means 68*a* and 68*b* are separated from the inner lids 38*a* and 38*b* brought to the open position (FIG. 11).

In a state where the outer lid 2 is located at the open position and the inner lids 38*a* and 38*b* are located at the open position (the state shown by the solid lines in FIG. 3), when the container is tilted in a required direction to direct downwardly one of the discharge ports 34*a* and 34*b* disposed at the leading ends of the discharge tubes 32*a* and 32*b*, the contents accommodated within the container, such as soy sauce, can be discharged through the one of the discharge ports 34*a* and 34*b*. In accordance with the discharge of the contents through the one of the discharge ports 34*a* and 34*b*, air flows into the container through the other of the discharge ports 34*a* and 34*b*, whereby discharge of the contents is promoted.

Figure 12:
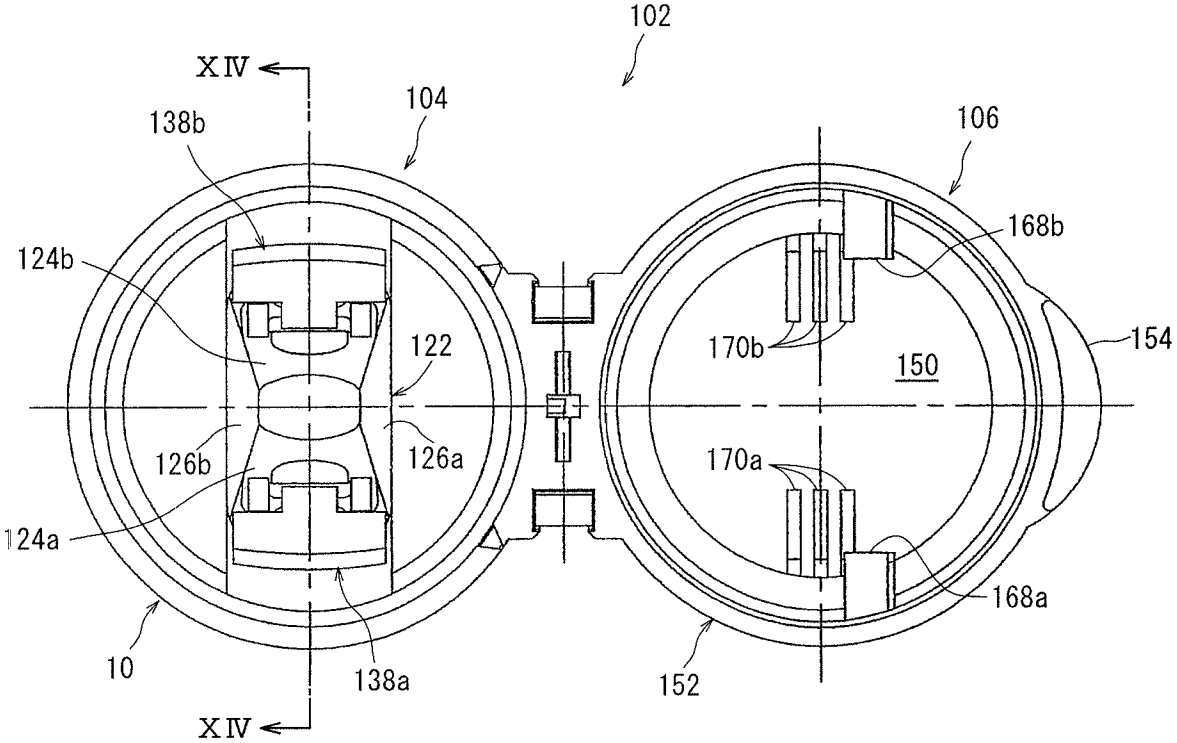
FIG. 12 is a plan view showing another embodiment of the container closure constituted in accordance with the first aspect of the present invention, in an as-molded state.
Figure 13:
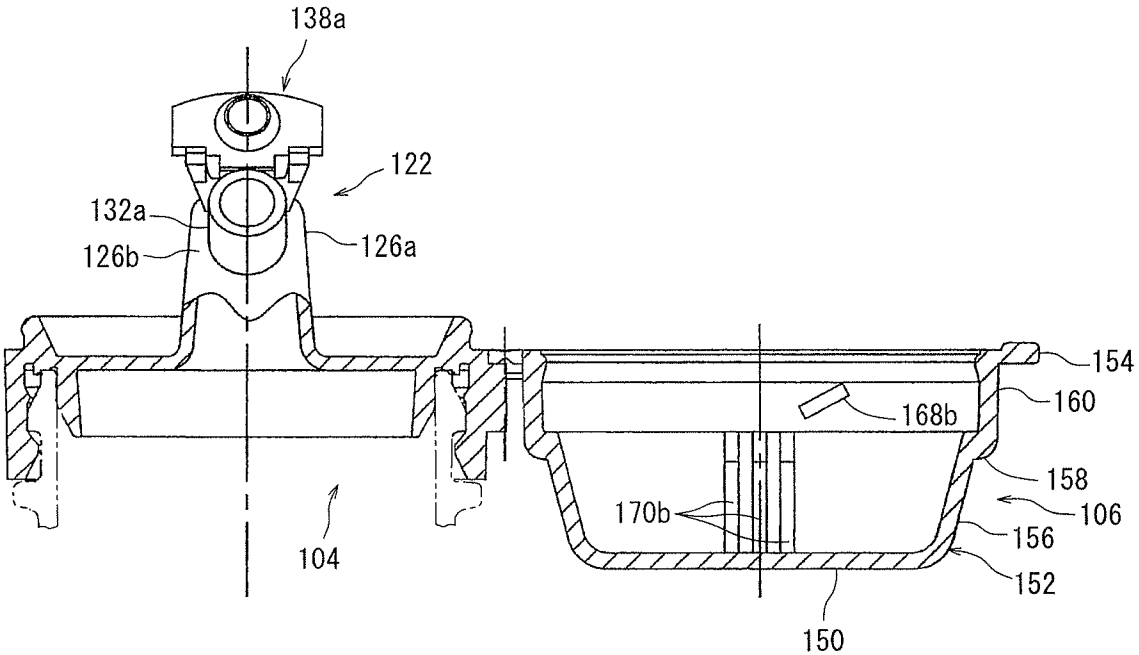
FIG. 13 is a front view showing the container closure of FIG. 12 partly in cross section.
Figure 14:
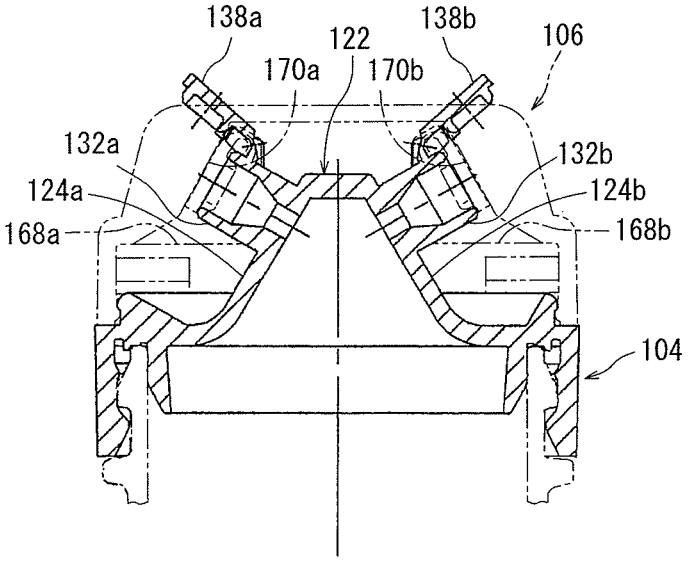
FIG. 14 is a sectional view taken on line XIV-XIV of FIG. 12

FIGS. 12 to 14 illustrate another embodiment of the container closure constituted in accordance with the present invention. In a body 104 of a container closure 102 shown in FIGS. 12 to 14, opposite side walls 124*a* and 124*b* of a raised portion 122 are inclined downwardly and outwardly in a lateral direction in FIG. 14 (i.e., bilaterally outwardly in the direction of the pivot axis of an outer lid 106 with respect to the body 104). Opposite end walls 126*a* and 126*b* of the raised portion 122 are also slightly inclined downwardly and outwardly in the lateral direction in FIG. 13. Cylindrical discharge tubes 132*a* and 132*b* extending out from the opposite side walls 124*a* and 124*b* are inclined upwardly. The relative relationship between the discharge tubes 132*a*, 132*b* and inner lids 138*a*, 138*b* is substantially the same as that in the case of the body illustrated in FIGS. 1 to 5. No barrier wall is disposed within the raised portion 122, so that the space within the raised portion 122 is not divided in two. The body 104 is substantially the same as the body 4 shown in FIGS. 1 to 5, except for the above-mentioned configuration. Needless to say, a barrier wall can be disposed where necessary.

In the outer lid 106 of the container closure 102 shown in FIGS. 12 to 14, the positions of disposition of interference means 168*a* and 168*b* and pressing means 170*a* and 170*b* are somewhat different from those of the outer lid 6 shown in FIGS. 1 to 5, in conformity with the configuration in which the inner lids 138*a* and 138*b* of the body 104 are disposed on the discharge tubes 132*a* and 132*b* extending out upwardly obliquely. In the outer lid 106, moreover, a top panel wall 150 is in a flat circular form, and an arcuate protruding piece 154 over which a finger can be hooked during the pivoting of the outer lid 106 is annexed to a required angular region at the lower end of a skirt wall 152, rather than on the top panel wall 150. The skirt wall 152 has a truncated cone-shaped upper part 156 and a cylindrical lower part 160, and an annular shoulder portion 158 is formed on the boundary between the upper part 156 and the lower part 160. The outer lid 106 is substantially the same as the outer lid 6 shown in FIGS. 1 to 5, except for the above-mentioned configuration.

Behaviors of the container closure 102 shown in FIGS. 12 to 14 when the outer lid 106 is moved for an opening or closing operation are substantially the same as those of the container 2 shown in FIGS. 1 to 5. Thus, their explanation will be omitted.

Figure 15:
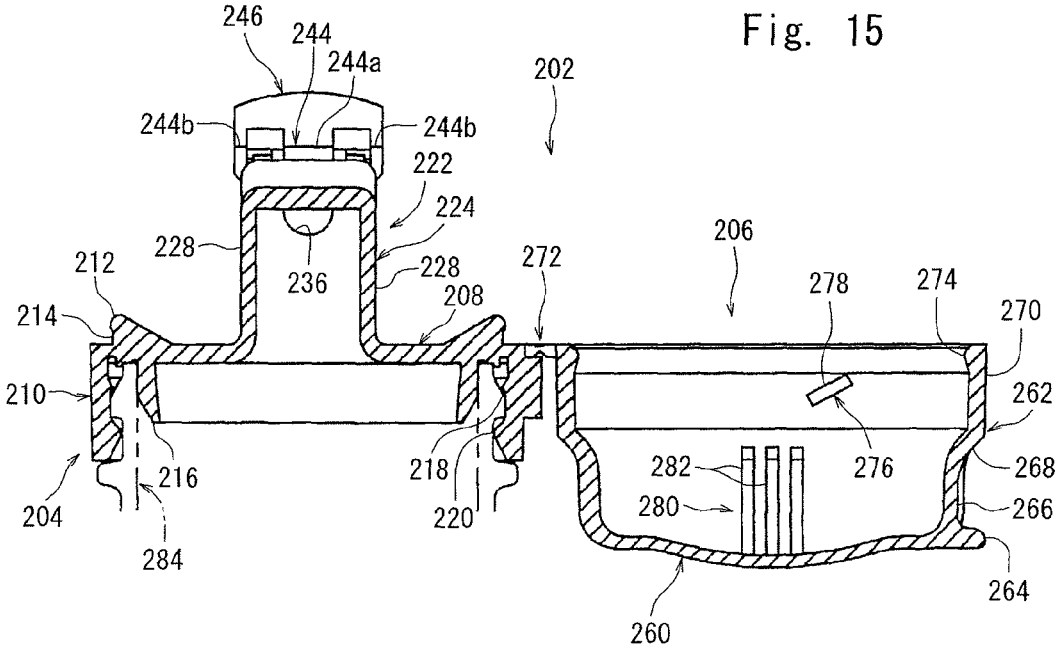
FIG. 15 is a right side view showing a preferred embodiment of a container closure constituted in accordance with a second aspect of the present invention, partly in cross section, in a state in which an outer lid is located at an open position.
Figure 16:
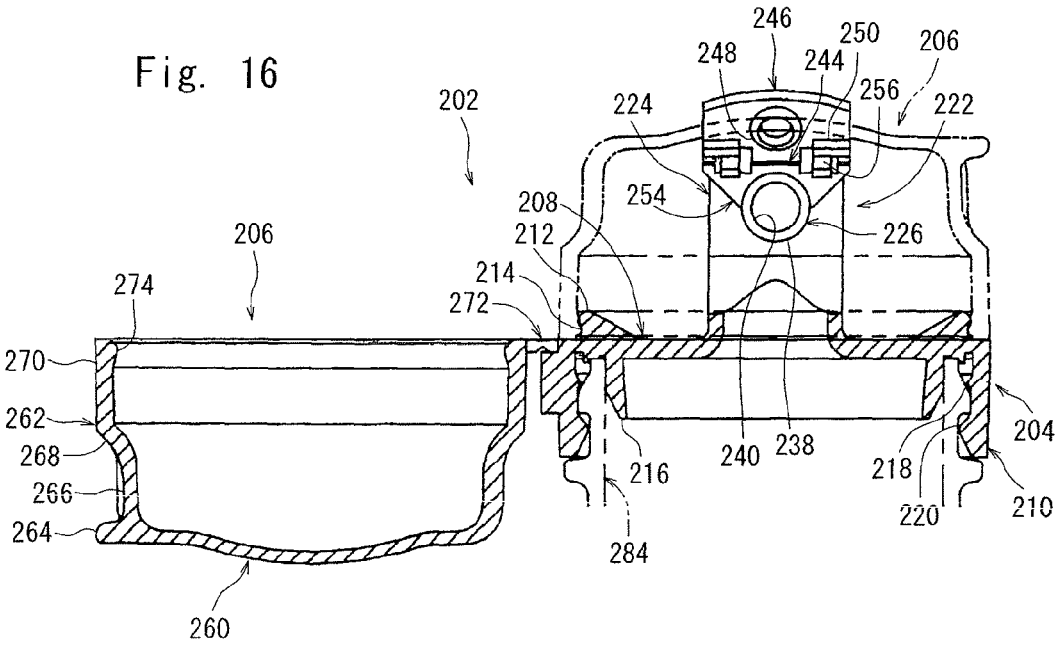
FIG. 16 is a left side view showing the container closure of FIG. 15 partly in cross section.

With reference to FIGS. 15 and 16, a container closure designated generally as the numeral 202, constituted in accordance with a second aspect of the present invention, can be integrally injection-molded from a suitable synthetic resin such as polyethylene or polypropylene, and is composed of a body 204 and an outer lid 206.

The body 204 has an upper surface wall 208, circular in a plan view, and a cylindrical side wall 210 extending downwardly from the peripheral edge of the upper surface wall 208. An annular ridge 212 protruding upward is formed in an outer peripheral edge part of the upper surface of the upper surface wall 208. An annular stop groove 214 is formed in a lower part of the outer peripheral surface of the annular ridge 212. An inner peripheral surface of the annular ridge 212 is inclined downwardly in a radially inward direction. A cylindrical sealing ridge 216 protruding downward is formed at the outer peripheral edge of the lower surface of the upper surface wall 208. An annular small ridge 218 is formed in an upper part of the inner peripheral surface of the side wall 210, and an annular stop ridge 220 is formed in a lower part of the inner peripheral surface of the side wall 210.

Figure 17:
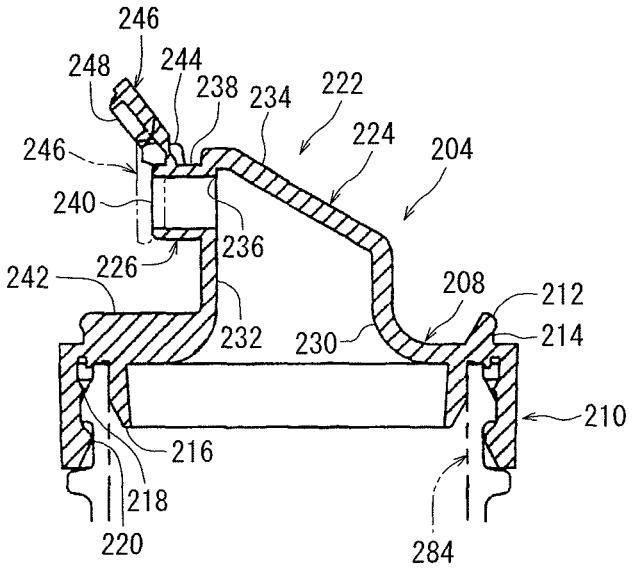
FIG. 17 is a sectional view of a body in the container closure shown in FIG. 15.

With further reference to FIG. 17 along with FIGS. 15 and 16, a discharge tube 222 rising upward is formed in the upper surface wall 208 of the body 204. The discharge tube 222 in the illustrated embodiment extends out substantially parallel to a first pivot axis to be described later, namely, in a direction perpendicular to the sheet face of FIG. 15, and leftward in FIG. 3. In further detail, the illustrated discharge tube 222 has a base portion 224 and a leading end portion 226. The base portion 224 is defined by a pair of side wall portions 228 protruding upward substantially vertically, a rear wall portion 230 extending in a nearly concave arcuate shape, a front wall portion 232 extending substantially vertically, and an upper wall portion 234 extending leftward in an upwardly inclined manner in FIG. 17. A through-hole 236 which may be circular is formed in an upper part of the front wall portion 232. The leading end portion 226 of the discharge tube 222 is defined by a cylindrical protruding tubular portion 238 protruding substantially horizontally from the front wall portion 232 of the base portion 224 and leftwardly in FIG. 17. The internal diameter of the protruding tubular portion 238 coincides with the internal diameter of the through-hole 236. A circular discharge port 240 is formed at the leading end of the protruding tubular portion 238. A bearer 242 is formed between the base portion of the discharge tube 222 and the annular ridge 212, and the upper surface of the bearer 242 extends substantially horizontally. In the illustrated embodiment, the discharge tube 222 is extended out leftward in FIG. 17, but if desired, can be extended out rightward in FIG. 17. The discharge tube 222 is extended out substantially parallel to the aforementioned first pivot axis, but if desired, can be inclined at an angle of $\alpha$, 0 degrees$<\alpha\leq$45 degrees, in a direction in which the discharge tube 222 gradually separates from the first pivot axis toward the leading end.

An inner lid 246 is connected via a hinge means 244 to the upper surface of the protruding tubular portion 238 of the discharge tube 222. Such an inner lid 246 is free to move between an open position indicated by solid lines in FIGS. 15 to 17 and a closed position indicated by dashed double-dotted lines in FIG. 17 (the movement of the inner lid 246 will be further mentioned later). The inner lid 246 is composed of a laterally elongated plate-shaped piece jutting out beyond the protruding tubular portion 238 of the discharge tube 222, and has an arcuate upper edge. A circular seal ring 248 is formed in a middle part in the width direction of the inner surface of the inner lid 246. The external diameter of the seal ring 248 is substantially the same as the internal diameter of the protruding tubular portion 238 of the discharge tube 222 and, when the inner lid 246 is brought to the closed position, the seal ring 248 is fitted into the protruding tubular portion 238 to seal the leading end of the protruding tubular portion 238. Stop projections 250 are formed in opposite side parts of the base end of the inner surface of the inner lid 246 (i.e., lower end in FIGS. 15 to 17). Such stop projections 250 have flat stop surfaces located at the lowermost position, with the inner lid 246 being located at the open position.

An extending-out piece 254 extending out upwardly and bilaterally is formed on the upper surface of the discharge tube 222, and receiving projections 256 as a pair are formed with spacing in the width direction (lateral direction in FIGS. 15 and 16) in the extending-out pieces 254. The receiving projections 256 have receiving surfaces which are preferably inclined forwardly downwardly (for the details of the receiving projection 256 and the stop projection 250, reference is requested to the aforementioned Patent Document 3). The hinge means 244 is disposed between the base end of the inner lid 246 and the leading end (upper end in FIGS. 15 and 16) of the extending-out piece 254. The hinge means 244 includes a middle hinge piece 244*a* disposed in a widthwise middle part (accordingly, between the paired receiving projections 256), and bilateral hinge pieces 244*b* disposed widthwise outwardly of the paired receiving projections 256. The middle hinge piece 244*a* and the bilateral hinge pieces 244*b* are arranged horizontally in a straight line to constitute a thin-walled line, and the inner lid 246 is pivotally moved about the thin-walled line as a pivot center line. If desired, the bilateral hinge pieces 244*b* can be omitted.

With further reference to FIGS. 15 and 16, the outer lid 206 has a top panel wall 260 and a cylindrical skirt wall 262 extending downwardly from the peripheral edge of the top panel wall 260. A middle part of the top panel wall 260 is bulged out somewhat upwardly. A flange 264 .protruding radially outwardly in a predetermined angular region is annexed to the top panel wall 260. As will be clearly understood by reference to FIGS. 18(*a*) to 18(*d*) along with FIGS. 15 and 16, the outer peripheral edge of the flange 264 is arc-shaped, and the lower surface of the flange 264 is also arc-shaped. In the illustrated embodiment, the skirt wall 262 has a cylindrical upper part 266, a truncated cone-shaped intermediate part 268, and a cylindrical lower part 270 (the terms "upper" and "lower" for the outer lid 206 mean upper and lower positions in the state of the outer lid 206 located at the closed position indicated by the dashed double-dotted lines in FIG. 16). A hinge means designated generally as the numeral 272 is disposed between the lower end of the outer peripheral surface of the skirt wall 262 of the outer lid 206 and the side wall 210 of the body 204 (the hinge means 272 constitutes a first hinge means, and its pivot axis constitutes the aforementioned first pivot axis). The outer lid 206 is connected to the body 204 via the hinge means 272 mentioned above, and the outer lid 206 is pivotally moved between an open position indicated by solid lines in FIGS. 15 and 16 and the closed position indicated by the dashed double-dotted lines in FIG. 16 (the pivotal movement of the outer lid 206 will be further mentioned later). The hinge means 272 may be of a well-known form per se, and thus an explanation for the configuration of the hinge means 272 is omitted.

A stop ridge 274 extending arcuately, except in the region where the hinge means 272 exists, is formed in a lower end part of the inner peripheral surface of the lower part 270 of the skirt wall 262. Further, an interference means 276 is also disposed on the inner peripheral surface of the skirt wall 262. In the illustrated embodiment, the interference means 276 is composed of a tongue-shaped piece 278 protruding radially inwardly from the inner peripheral surface of the lower part 270 of the skirt wall 262 at a site spaced from the hinge means 272 at an angle of about 100 degrees. Such a tongue-shaped piece 278 is located slightly above the stop ridge 274, and extends in a downwardly inclined manner, at a predetermined angle optionally of the order of 30 degrees, away from the above-mentioned first pivot axis when the outer lid 206 is located at the closed position indicated by the dashed double-dotted lines in FIG. 17. If desired, instead of inclining the tongue-shaped piece 278, it is permissible to incline the pivot axis of the hinge means 244 constituting the second hinge means, i.e., the second pivot axis, upwardly at a predetermined inclination angle away from the first pivot axis. A pressing means 280 is also disposed on the inner peripheral surface of the skirt wall 262. In the illustrated embodiment, the pressing means 280 is composed of three pressing pieces 282 protruding, with spacing in the circumferential direction, from the inner peripheral surface of the upper part 266 of the skirt wall 262 and a peripheral edge part of the inner surface of the top panel wall 260 at a site spaced from the hinge means 272 at an angle of about 90 degrees. Each of the pressing pieces 282 is extended substantially vertically, and a lower end part of the protruding edge of each pressing piece is inclined downwardly outwardly. If desired, the pressing means 280 can be composed of a single wide pressing piece extending uninterruptedly in the width direction.

The above-mentioned container closure 202 is applied preferably to a mouth-and-neck portion 284 of a container accommodating a liquid such as an edible oil or a liquid seasoning. When the container closure 202 is to be mounted on the mouth-and-neck portion 284 of the container, an upper end part of the mouth-and-neck portion of the container is inserted into an annular space between the side wall 210 and the sealing ridge 216 of the body 204, and the mouth-and-neck portion is sealed with the sealing ridge 216 advancing into the mouth-and-neck portion.

When the outer lid 206 is located at the closed position indicated by the dashed double-dotted lines in FIG. 16, the stop ridge 274 formed in the lower end part of the inner peripheral surface of the skirt wall 262 of the outer lid 206 is engagingly stopped by the stop groove 214 formed in the lower part of the outer peripheral surface of the annular ridge 212 of the body 204, whereby the outer lid 206 is maintained at the closed position. When the outer lid 206 is located at the closed position, moreover, the pressing means 280 contacts the outer surface of the inner lid 246 (namely, the surface opposite to the surface on which the seal ring 248 is formed) to force the inner lid 246 into the closed position, thus sealing the discharge port 240 of the discharge tube 222 fully reliably.

Figure 18:
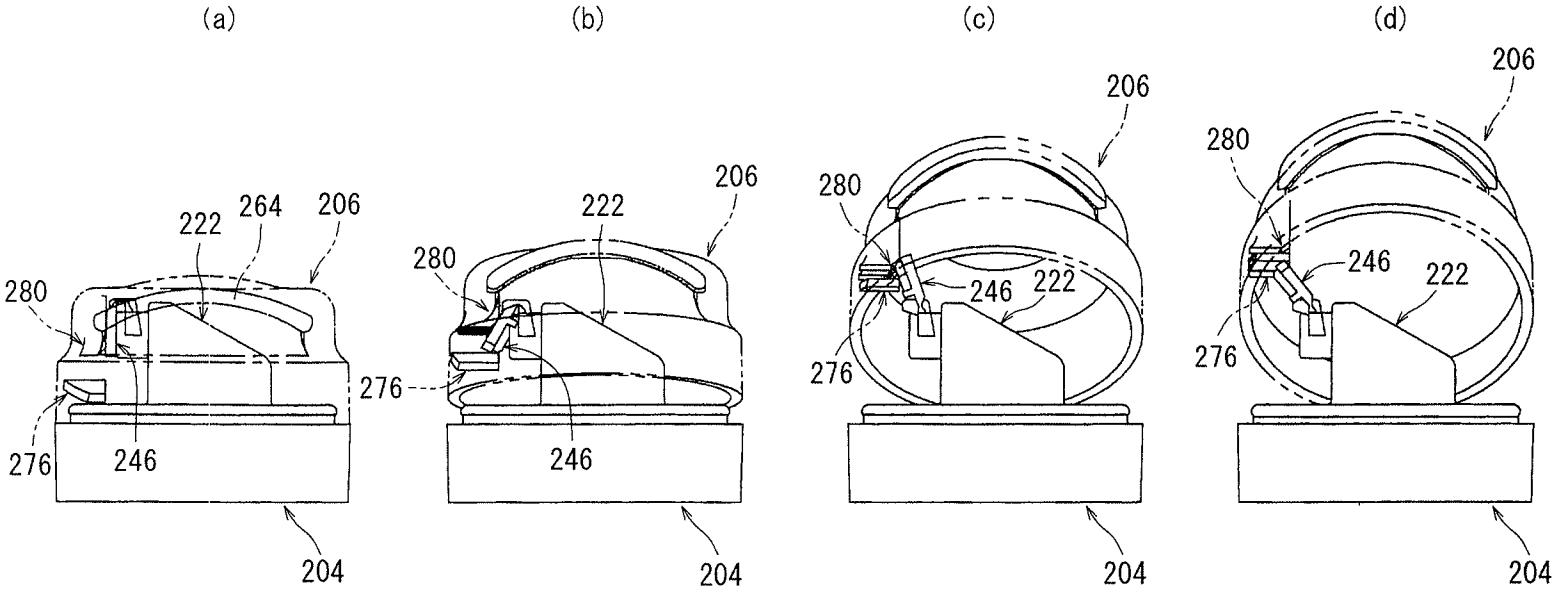
FIGS. 18(*a*) to 18(*d*) are front views showing behaviors of the container closure shown in FIG. 15 when the outer lid is pivotally moved from a closed position to the open position.

When the contents accommodated in the container having the container closure 202 mounted thereon are to be consumed, a finger is hooked on the flange 264 annexed to the top panel wall 260 of the outer lid 206 to pivotally move the outer lid 206 from the closed position indicated by the dashed double-dotted lines in FIG. 16 toward the open position indicated by the solid lines in FIGS. 15 and 16. With further reference to FIGS. 18(*a*) to 18(*d*) along with FIGS. 15 and 16, when the outer lid 206 is moved, for opening, from the position illustrated in FIG. 18(*a*) to the position illustrated in FIG. 18(*b*), the pressing means 280 is separated from the outer surface of the inner lid 246, and the interference means 276 formed on the inner peripheral surface of the skirt wall 262 of the outer lid 206 contacts the lower surface of the inner lid 246 to begin interfering with the inner lid 246. Then, when the outer lid 206 is moved, for opening, from the position illustrated in FIG. 18(*b*) to the position illustrated in FIG. 18(*c*), the stop projections 250 disposed on the inner lid 246 to be opened in association with the opening movement of the outer lid 206 resiliently ride over the receiving projections 256 disposed in the discharge tube 222. When the outer lid 206 is further moved, for opening, to the position illustrated in FIG. 18(*d*), the inner lid 246 is also further moved for opening attendantly. When the outer lid 206 is further moved, for opening, beyond the position illustrated in FIG. 18(*d*), however, the interference means 276 of the outer lid 206 is separated from the inner lid 246. Upon separation of the interference means 276 of the outer lid 206 from the inner lid 246, the inner lid 246 tends to be resiliently moved for closing toward the closed position. However, the stop surfaces of the stop projections 250 of the inner lid 246 contact the receiving surfaces of the receiving projections 256 disposed in the discharge tube 222. As a result, the closing movement of the inner lid 246 is inhibited, and the inner lid 246 is maintained at the open position.

As noted above, when the outer lid 206 is moved for opening, the inner lid 246 is moved for opening in accordance with this movement. Thus, the consumer can discharge the contents of the container through the discharge tube 222 without the need to hook his or her finger on the inner lid 246 itself and move it for opening. In the container closure 202 constituted in accordance with the present invention, in particular, the discharge tube 222 is extended along the first pivot axis, namely, the pivot axis of the hinge means 272. Thus, when the container is grasped with the right hand and the outer lid 206 is moved for opening from the closed position to the open position with the use of the left hand, for example, the discharge port 240 disposed at the leading end of the discharge tube 222 points in a direction nearly orthogonal to the left wrist. Hence, the right wrist may be rotated rightward (rotated leftward if the direction of extension of the discharge tube 222 is opposite to that in the illustrated embodiment), without the need to release the grasp of the container once and grasp the container again. By so doing, the discharge port 240 can be directed downward to discharge the contents through the discharge port 240.

Figure 19:
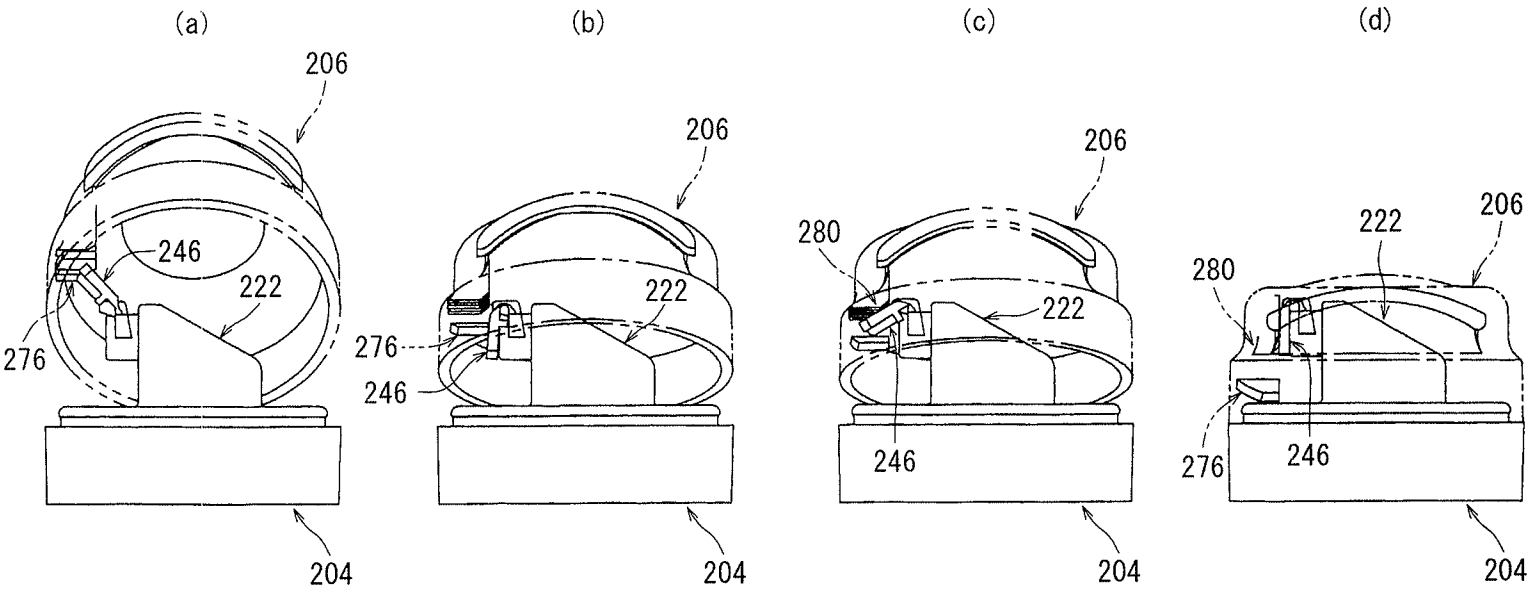
FIGS. 19(*a*) to 19(*d*) are front views showing behaviors of the container closure shown in FIG. 15 when the outer lid is pivotally moved from the open position to the closed position.

After the consumption of the contents is completed, the outer lid 206 is moved pivotally from the open position illustrated in FIGS. 15 and 16 to the closed position indicated by the dashed double-dotted lines in FIG. 16. With further reference to FIGS. 19(*a*) to 19(*d*) along with FIGS. 15 and 16, when the outer lid 206 is moved, for closing, to the position illustrated in FIG. 19(*a*), the interference means 276 formed on the skirt wall 262 of the outer lid 206 contacts the outer surface of the inner lid 246, which is located at the open position, to begin interfering with the inner lid 246. Then, when the outer lid 206 is moved, for closing, from the position illustrated in FIG. 19(*a*) to the position illustrated in FIG. 19(*b*), the inner lid 246 is also moved for closing in accordance with the closing motion of the outer lid 206, and the stop projections 250 disposed on the inner lid 246 resiliently ride over the receiving projections 256 disposed in the discharge tube 222. When the outer lid 206 is moved, for closing, from the position illustrated in FIG. 19(*b*) to the position illustrated in FIG. 19(*c*), the inner lid 246 is also moved for closing attendantly. The inner lid 246 is once brought to the closed position at which it seals the discharge port 240 of the discharge tube 222. After the interference means 276 of the outer lid 206 is separated from the inner lid 246, however, the inner lid 246 tends to be somewhat pivoted in the opening direction owing to its resilient restoring action, as shown in FIG. 19(*c*). However, when the outer lid 206 is moved for closing to the closed position shown in FIG. 19(*d*), the pressing means 280 disposed on the outer lid 206 contacts the outer surface of the inner lid 246 to force the inner lid 246 into the closed position. Moreover, the stop ridge 274 formed in the outer lid 206 is engagingly stopped by the stop groove 214 fainted in the annular ridge 212 of the body 204, whereby the outer lid 206 is held at the closed position.

EXPLANATIONS OF LETTERS OR NUMERALS

2: Container closure
4: Body
6: Outer lid
8: Upper surface wall of body
10: Cylindrical side wall of body
22: Raised portion
24*a*: Side wall of raised portion
24*b*: Side wall of raised portion
32*a*: Discharge tube
32*b*: Discharge tube
34*a*: Discharge port
34*b*: Discharge port
36: Barrier wall
38*a*: Inner lid
38*b*: Inner lid
46*a*: Stop projection
46*b*: Stop projection
48*a*: Receiving projection
48*b*: Receiving projection
50: Top panel wall of outer lid
52: Skirt wall of outer lid
68*a*: Interference means
68*b*: Interference means
70*a*: Pressing means
70*b*: Pressing means
72: Mouth-and-neck portion of container
102: Container closure
104: Body
106: Outer lid
122: Raised portion
124*a*: Side wall of raised portion
124*b*: Side wall of raised portion
132*a*: Discharge tube
132*b*: Discharge tube
138*a*: Inner lid
138*b*: Inner lid
150: Top panel wall of outer lid
152: Skirt wall of outer lid
202: Container closure
204: Body
206: Outer lid
208: Upper surface wall of body
210: Side wall of body
222: Discharge tube
244: Hinge means (second hinge means)
246: Inner lid
260: Top panel wall of outer lid
262: Skirt wall of outer lid
272: Hinge means (first hinge means)
276: Interference means
280: Pressing means

The invention claimed is:

1. A container closure integrally formed from a synthetic resin and including a body, which has an upper surface wall and a cylindrical side wall extending downwardly from a peripheral edge of the upper surface wall, and an outer lid, which has a top panel wall and a cylindrical skirt wall extending downwardly from a peripheral edge of the top panel wall, wherein the skirt wall of the outer lid and the side wall of the body are connected via first a hinge which defines a first pivot axis extending horizontally, and the outer lid is free to pivot, about the first pivot axis as a pivot center, between a closed position at which the upper surface wall of the body is covered and an open position at which the upper surface wall of the body is exposed; and a raised portion which rises upward and which has discharge ports formed on opposite sides thereof in a direction of the first pivot axis is disposed in a middle part of the upper surface wall of the body, wherein inner lids are connected to the raised portion via a second hinge, in association with the discharge ports, respectively, so as to be pivotable between a closed position at which the discharge ports are covered and an open position at which the discharge ports are opened;

interference members are disposed on an inner peripheral surface of the skirt wall of the outer lid, in association with the inner lids, respectively, such that the interference members interfere with the inner lids to pivot the inner lids from the open position toward the closed position while the outer lid is being pivoted from the open position to the closed position, and then the interference members ride over the inner lids and become separated from the inner lids, and that the interference members interfere with the inner lids to pivot the inner lids from the closed position toward the open position while the outer lid is being pivoted from the closed position to the open position, and then the interference members are separated from the inner lids, and a barrier wall hanging down from a middle of an inner surface of an upper end wall of the raised portion to cut off from each other the discharge ports formed on the opposite sides of the raised portion in the direction of the first pivot axis is formed in the raised portion.

2. The container closure according to claim 1, wherein each of the interference members comprises a tongue-shaped piece protruding radially inwardly from the inner peripheral surface of the skirt wall of the outer lid, and extending in a downwardly inclined manner away from the first pivot axis.

3. The container closure according to claim 1, wherein pressing members are disposed on the inner peripheral surface of the skirt wall of the outer lid, in association with the inner lids, respectively, such that the pressing members contact outer surfaces of the inner lids to force the inner lids into the closed position while the outer lid is being pivoted from the open position to the closed position.

4. The container closure according to claim 1, wherein the raised portion has opposite side walls on the opposite sides thereof in the direction of the first pivot axis, the opposite side walls extending vertically, and the discharge ports are defined at leading ends of discharge tubes protruding horizontally from the opposite side walls, respectively.

5. The container closure according to claim 1, wherein stop projections are formed in opposite side parts of an inner surface of the inner lid, receiving projections as a pair are formed in the raised portion in correspondence with the stop projections, and the stop projections resiliently ride over the receiving projections when the inner lid is pivoted from the closed position to the open position.

6. A container closure integrally formed from a synthetic resin and including a body, which has an upper surface wall and a cylindrical side wall extending downwardly from a peripheral edge of the upper surface wall, and an outer lid, which has a top panel wall and a cylindrical skirt wall extending downwardly from a peripheral edge of the top panel wall, wherein the skirt wall of the outer lid and the side wall of the body are connected via first a hinge which defines a first pivot axis extending horizontally, and the outer lid is free to pivot, about the first pivot axis as a pivot center, between a closed position at which the upper surface wall of the body is covered and an open position at which the upper surface wall of the body is exposed; and a raised portion which rises upward and which has discharge ports formed on opposite sides thereof in a direction of the first pivot axis is disposed in a middle part of the upper surface wall of the body, wherein inner lids are connected to the raised portion via a second hinge, in association with the discharge ports, respectively, so as to be pivotable between a closed position at which the discharge ports are covered and an open position at which the discharge ports are opened;

interference members are disposed on an inner peripheral surface of the skirt wall of the outer lid, in association with the inner lids, respectively, such that the interference members interfere with the inner lids to pivot the inner lids from the open position toward the closed position while the outer lid is being pivoted from the open position to the closed position, and then the interference members ride over the inner lids and become separated from the inner lids, and that the interference members interfere with the inner lids to pivot the inner lids from the closed position toward the open position while the outer lid is being pivoted from the closed position to the open position, and then the interference members are separated from the inner lids, wherein the raised portion has opposite side walls on the opposite sides thereof in the direction of the first pivot axis, the opposite side walls extending downwardly and being inclined bilaterally outwardly in the direction of the first pivot axis, and the discharge ports are defined at leading ends of discharge tubes, the discharge tubes extending out upwardly from the opposite side walls, respectively, and being inclined bilaterally outwardly in the direction of the first pivot axis.

7. A container closure integrally formed from a synthetic resin and including a body, which has an upper surface wall and a cylindrical side wall extending downwardly from a peripheral edge of the upper surface wall, and an outer lid, which has a top panel wall and a cylindrical skirt wall extending downwardly from a peripheral edge of the top panel wall, wherein the skirt wall of the outer lid and the side wall of the body are connected via a first hinge which defines a first pivot axis extending horizontally; the outer lid is free to pivot between a closed position at which the upper surface wall of the body is covered and an open position at which the upper surface wall is exposed; a discharge tube having a discharge port formed at a leading end thereof is disposed on the upper surface wall of the body; an inner lid is connected to an upper surface of the discharge tube via a second hinge, which defines a second pivot axis, so as to be pivotable between a closed position at which the discharge port is covered and an open position at which the discharge port is opened; and an interference member is disposed on an inner peripheral surface of the skirt wall of the outer lid such that the interference member interferes with the inner lid to move the inner lid pivotally from the closed position to the open position while the outer lid is being pivoted from the closed position to the open position, and then the interference member rides over the inner lid and becomes separated from the inner lid, and that the interference member interferes with the inner lid to pivot the inner lid from the open position toward the closed position while the outer lid is being pivoted from the open position to the closed position, and then the interference member is separated from the inner lid, wherein the discharge tube is extended out along the first pivot axis, the discharge tube is extended out parallel to the first pivot axis, or at an inclination angle of $\alpha$, 0 degrees $<\alpha\leq 45$ degrees, in a direction in which the discharge tube gradually separates from the first pivot axis toward the leading end, and the interference member is composed of a tongue-shaped piece protruding radially inwardly from the inner peripheral surface of the skirt wall of the outer lid, and the tongue-shaped piece extends in a downwardly inclined manner away from the first pivot axis when the outer lid is located at the closed position and/or the second pivot axis extends upwardly obliquely away from the first pivot axis.

* * * * *